US007216473B1

(12) United States Patent
McArthur et al.

(10) Patent No.: US 7,216,473 B1
(45) Date of Patent: May 15, 2007

(54) TURBOJET ENGINE LUBRICATION SYSTEM

(75) Inventors: Malcolm J. McArthur, Fallbrook, CA (US); Anthony C. Jones, San Diego, CA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 0 days.

(21) Appl. No.: 09/350,552

(22) Filed: Jul. 9, 1999

(51) Int. Cl.
*F02C 7/06* (2006.01)

(52) U.S. Cl. ..... 60/39.08; 184/6.11

(58) Field of Classification Search ..... 60/39.08; 184/6.11
See application file for complete search history.

(56) References Cited

U.S. PATENT DOCUMENTS 3,856,114 A * 12/1974 Zankl ..... 184/6.11
4,015,426 A * 4/1977 Hobo et al. ..... 60/39.281
4,390,082 A * 6/1983 Swearingen ..... 60/39.08
4,569,196 A * 2/1986 Waddington et al. ..... 60/39.08
4,697,414 A * 10/1987 McCarty ..... 60/39.08
4,983,051 A * 1/1991 Hibner et al. ..... 184/6.11
5,040,366 A * 8/1991 Schulze ..... 60/39.08
5,067,454 A * 11/1991 Waddington et al. .... 123/196 S
5,076,755 A * 12/1991 Okada ..... 415/17
6,024,491 A * 2/2000 Bak ..... 384/3.2
6,209,309 B1 * 4/2001 McArthur ..... 60/39.03

OTHER PUBLICATIONS

Description of K.O. Lee Model S1024N3 Surface Grinder (http://www.kolee.com/surface.htm).
Welsh Machinery description of Amera-Seiki A-3 CNC Vertical Machining Centre (http://www.welshmachinery.com/vertical_mac/verticals_mits.asp?qsMan=-Amera-seiki&refno=A32005).

* cited by examiner

*Primary Examiner*—Ted Kim
(74) *Attorney, Agent, or Firm*—Stephen G. Mican

(57) ABSTRACT

A lubrication system for an expendable gas turbine engine (20) having a rotatable shaft (26) is provided. Bearings (28) journal the shaft (26) for rotation about an axis. The system includes a vessel (46) for containing lubricating oil, a conduit (58) extending from the vessel (46) to the bearings (28), and a solenoid operated valve (70,76) in the conduit (58) and operable to only either fully open or fully closed. A control circuit (16) is provided for pulsing the solenoid (70) at a controlled rate to alternatingly (a) allow oil flow and (b) halt oil flow to the bearings (28) for a time insufficient to cause oil starvation of the bearings (28).

13 Claims, 2 Drawing Sheets

TURBOJET ENGINE LUBRICATION SYSTEM

FIELD OF THE INVENTION

This invention relates to lubrication systems for gas turbine engines, and even more particularly, to lubrication systems for expendable turbojet engines.

BACKGROUND OF THE INVENTION

Gas turbine engines conventionally include a rotary compressor, a turbine, and a rotary shaft interconnecting the two. As is typical in equipment of all sorts having rotatable components, except when exotic bearings, such as magnetic bearings, are employed, it is necessary to provide for lubrication of the rotary components. In typical gas turbine engines, lubricating oil is provided to bearings journalling the rotary components, recovered and then recycled. These systems require pumps for recovering the lubricating oil as well as for circulating the lubricating oil. While such systems perform quite adequately, they can be heavy and/or bulky, not to mention expensive in construction. As a consequence, they are not suitable for use in all gas turbine systems.

For example, cruise missiles and target drones used by the military are frequently powered by small turbojet engines. Because these airborne vehicles are intended to be used, in the case of a cruise missile, but a single time, and in the case of target drones, no more than a couple of times, the turbojet engines employed are designed to be inexpensive to thereby provide an expendable engine. It accordingly follows that it is desirable that engine supporting systems, including the lubrication system, likewise be inexpensive as well. And because such engines are frequently used in airborne vehicles, it is highly desirable to minimize weight so that payload and/or range may be maximized.

At the same time, the lubrication system must be capable of operating reliably for the life of the engine and over a wide range of temperatures, typically from minus 40° F. to plus 180° F. Because these engines typically operate at a high rpm, a shaft or gear driven pump system is impractical as well as expensive.

Typically, the engines employed are relatively small and consequently, the lubricant flow rate is similarly small. Nonetheless, the flow must be reliable and delivered within the desired range under any and all conditions of operation. Typically, oil flows in the range of 1.5 cc per minute to 2.5 cc per minute are employed. To reliably obtain such flows when the oil experiences substantial changes in viscosity, dependent upon ambient temperature, poses substantial difficulty. Too little oil flow results in bearing failure and too great of an oil flow can result in premature exhaustion of oil and bearing failure.

Specifically, the nature of the system is that the maximum rate for the total oil flow has to be limited to assure that lubricating oil is available at or near the end of the mission cycle. Furthermore, the maximum rate has to be limited so as to enable the minimization of the size of the oil tank. Moreover, the system additionally has to be capable of being stored in the state of non-use with its compliment of lubricating oil for up to 15 years without loss and at the same time be ready for use immediately upon demand.

The present invention is directed to providing a lubricating oil system meeting these and other needs.

SUMMARY OF THE INVENTION

It is the principal object of the invention to provide a new and improved lubricating system for a gas turbine engine. More specifically, it is an object of the invention to provide a new and improved lubricating system for a turbojet engine; and even more specifically, it is an object of the invention to provide a new and improved lubricating system for an expendable turbojet engine mounted on an airborne vehicle.

An exemplary embodiment of the invention includes a lubrication system for an expendable, gas turbine engine which includes a gas turbine engine having a rotatable shaft. Bearings journal the shaft for rotation about an axis. A vessel containing lubricating oil is provided and a conduit extends from the vessel to the bearings. A solenoid operated valve is located in the conduit and is operable only to either fully open or fully close. A control circuit is provided for pulsing the solenoid at a controlled rate to alternatingly (a) allow oil flow; and (b) halt oil flow to the bearings for a time insufficient to cause oil starvation of the bearings.

In one embodiment of the invention, the vessel includes a tank and a bladder is disposed within the tank. Also provided is a source of gas under pressure. One or the other of the tank and the bladder contain lubricating oil for the bearings and the other of the tank and the bladder is connectable to the source of gas under pressure. By pressurizing the other of the tank and the bladder, lubricating oil is expelled into the conduit whenever the solenoid valve opens.

In one embodiment, the tank contains the lubricating oil and the gas under pressure is admitted to the bladder. In another embodiment, the bladder contains the lubricating oil and the tank receives the gas under pressure.

In a highly preferred embodiment, the time over which the valve is closed is no more than about 3 seconds.

A preferred embodiment includes a metering orifice in the conduit between the bearings and the solenoid valve.

A highly preferred embodiment further includes a pressure regulator operatively interposed between the one of the tank and the bladder receiving gas under pressure.

According to the embodiment mentioned immediately preceding, the pressure regulator receives an input representative of the pressure at the bearings.

In a highly preferred embodiment, the engine is mounted in a vehicle and the control circuit receives inputs indicative of vehicle velocity and temperature of the lubricating oil.

Even more preferably, the vehicle is an airborne vehicle and the control circuit additionally receives an input representative of the altitude of the vehicle.

Preferably, the tank is in sufficiently close proximity to the engine so as to receive heat rejected by the engine so that the lubricating oil is warmed by engine operation to reduce its viscosity.

The invention also contemplates that the source of gas under pressure may be pressurized gas stored in a pressure vessel or air under pressure from the compressor section of the turbine engine.

Other objects and advantages will become apparent from the following specification taken in connection with the accompanying drawings.

DESCRIPTION THE DRAWINGS

DESCRIPTION OF THE PREFERRED EMBODIMENTS

Figure 1:
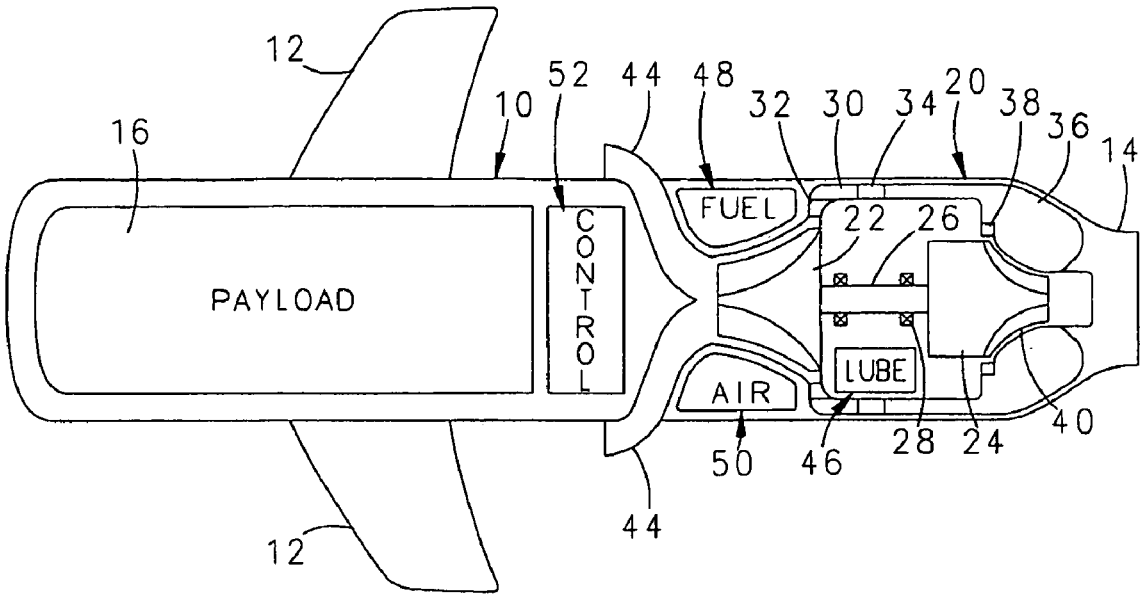
FIG. 1 is a somewhat schematic sectional view of an airborne vehicle powered by a turbojet engine and embodying a lubrication system made according to the invention.

An exemplary embodiment of the invention is illustrated in the environment of a turbojet driven airborne vehicle of the expendable type, such as a cruise missile or a target drone. The vehicle includes a vehicle body, generally designated 10, which may or may not be provided with wings 12 of conventional construction. At the rear of the body 10 is a jet nozzle 14 by which the body 10 is propelled as a result of hot gases of combustion exiting the nozzle 14.

In the forward part of the body 10, a payload 16 is located. In the case of a cruise missile, the payload would be munitions whereas in the case of a target drone, the payload 16 might include a parachute or the like to allow recovery and possible re-use of the target drone.

At the rear of the body 10, a small expendable turbojet engine, generally designated 20, is provided. In the illustrated embodiment, the turbojet engine 20 is of the radial flow type and includes a rotary compressor 22 of conventional construction coupled to a turbine wheel 24 by means of a shaft 26 journalled by bearings 28. The turbojet engine includes an annular passage 30 including diffuser vanes 32 and anti-swirl vanes 34 and which extends to an annular combuster 36. The annular combuster includes a nozzle 38 which directs gases of combustion against blades 40 on the turbine wheel 24 to rotate the same. The gases of combustion are expelled by the nozzle 14 while rotation of the compressor wheel 22 by reason of the coupling between the turbine 24 and the compressor wheel 22 by the shaft 26 serves to provide compressed combustion air to the combuster 36.

Ram air scoops 44 may extend to just outside of the vehicle body 10 to capture ambient air and direct it to the compressor wheel 22 as is well known.

A source of lubricating oil, generally designated 46, is illustrated in the drawing as being located between the compressor wheel 22 and the turbine 24. However, there are a multitude of other locations which may be employed as well. It is highly desirable that the source of lubricating oil 46 be located in close proximity to the engine 20 so that heat rejected by the engine 20 to the interior of the vehicle body 10 will warm lubricating oil contained in the source 46 to reduce its viscosity.

Elsewhere within the body 10 is a source of fuel 48 for the engine 20 as well as a source of compressed gas under pressure, generally designated 50, which may be compressed air stored in a small pressure vessel.

Finally, the missile 10 includes a control system, generally designated 52.

Figure 2:
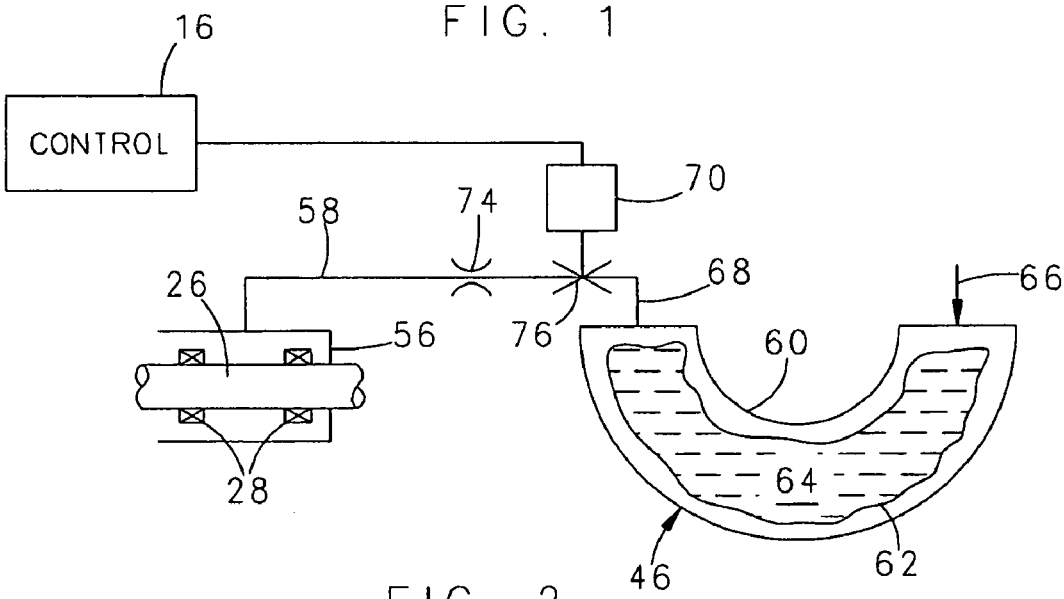
FIG. 2 is a somewhat simplified schematic of part of the lubrication system.

Turning now to FIG. 2, the area of the engine 20 containing the bearings 28 is a bearing cavity 56 of conventional construction. Lubricating oil is introduced into the cavity 56 via a conduit 58.

One form of the lubricating oil source 46 is shown in FIG. 2 and is seen to include an arcuate tank 60 shaped to fit within the body 10 and containing an interior, flexible bladder 62. A body of lubricating oil 64 is contained within the bladder 62. An inlet to the tank 60 is shown schematically at 66 and is connected to the pressurized gas source 50 in a manner to be seen. In any event, upon the admission of pressurized gas to the interior of the tank 60 via the inlet 66, pressure is exerted against the bladder 62 to expel the lubricant 64 via an outlet 68 connected to the conduit 58.

Within the conduit 58, between the source 50 of lubricating oil and the bearing cavity 56 is a solenoid operated valve 70. The solenoid operated valve 70 is of the type that is either fully open or fully closed. That is to say, the valve 70 does not have an analog modulating function. It is operated by the control 16 to alternatingly open and close at a variable rate while the source 50 is being pressurized so that an intermittent flow of lubricant 64 to the bearing cavity 56 results. Preferably, a metering orifice 74 is located in the conduit 56 downstream of the valve 70 to limit the maximum flow rate.

It has been determined that the engine 20 may operate without damage to the bearings 28 even when the flow of lubricating oil to the bearing cavity 56 is interrupted for as long as three seconds. Consequently, the total oil flow to the bearings 28 may be regulated by appropriately energizing and de-energizing the solenoid 70 to open and close the valve 76 associated therewith to provide what might be termed a "digital modulation" of oil flow.

Figure 3:
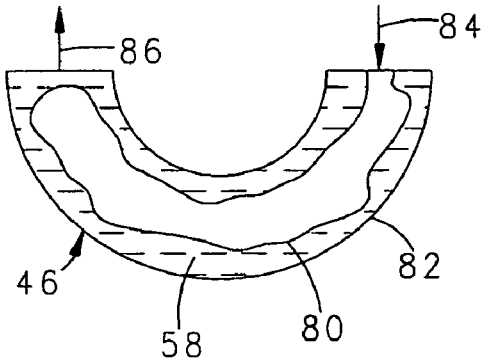
FIG. 3 illustrates a form of a vessel for storing lubricating oil that may be used as an alternative to that shown in FIG. 2.

An alternative form of the source of lubricating oil 50 is illustrated in FIG. 3. In this embodiment, a flexible bladder 80 is disposed within an arcuate tank 82. In this case, however, the bladder 80 is connected to a pressurized gas inlet 84 which is ultimately connected to the source 50 and an outlet 86 connected to be in fluid communication with the interior of the tank 82, but not the bladder, is provided for connection via the conduit 58 to the bearing cavity 56. In this embodiment, the admission of pressurized gas through the inlet 84 to the interior of the bladder 80 results in a body of oil 88 being subjected to pressure so it will flow through the outlet 86 to the bearing cavity 56.

Either form of the source of lubricating oil 46 shown in FIGS. 2 and 3 may be employed. It is noted that bladder and tank type sources are highly desirable in that they allow complete depletion of the lubricating oil 64,88 from the source 46 as a result of pressure applied to the exterior of the bladder 62 or to the interior of the bladder 80, as the case may be.

Figure 4:
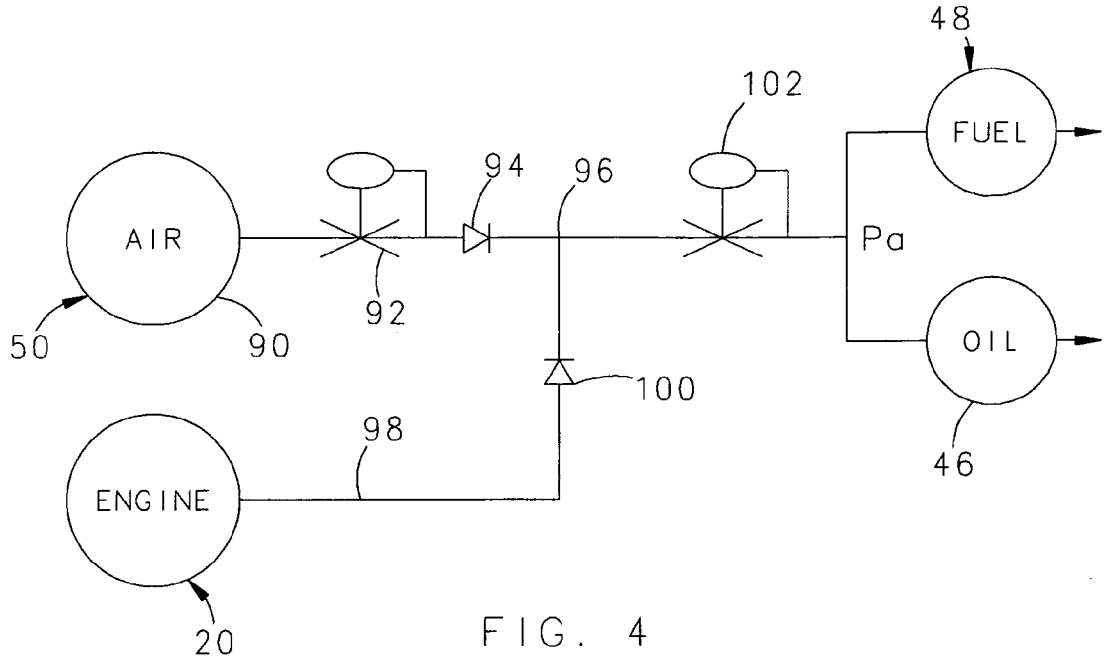
FIG. 4 shows a pressurization system for use with the oil storage vessels shown in either FIG. 2 or FIG. 3.

FIG. 4 illustrates a means of providing gas under pressure to the lubricant source 40, as well as to the source of fuel 48 which may be a similar bladder and tank construction. The gas source 50 may include a pressure bottle 90 connected by a selectively operable valve (not shown) to a pressure regulator 92 and then via a check valve 94 to a junction 96. The compressor section of the engine 20 may be tapped via a line 98 to obtain bleed air which is then passed through a check valve 100 to the junction 98. The junction 98 is then connected to the fuel source 48 and the oil source 46 via a pressure regulator 102. This system allows a stored gas to be utilized for initial pressurization of both the lubricating oil source 46 and the fuel source 48 with bleed air from the engine 20 taking over the pressurization function after the engine 20 has been started and brought up to operating speed. As the bottle 90 does not need to provide pressurized gas for the entire mission, its size may be reduced. In both cases, back flow is prevented by the check valves 94 and 100 and a gas at a desired pressure, designated "$P_a$" in the drawings is provided to the oil and fuel sources 46 and 48 respectively.

Figure 5:
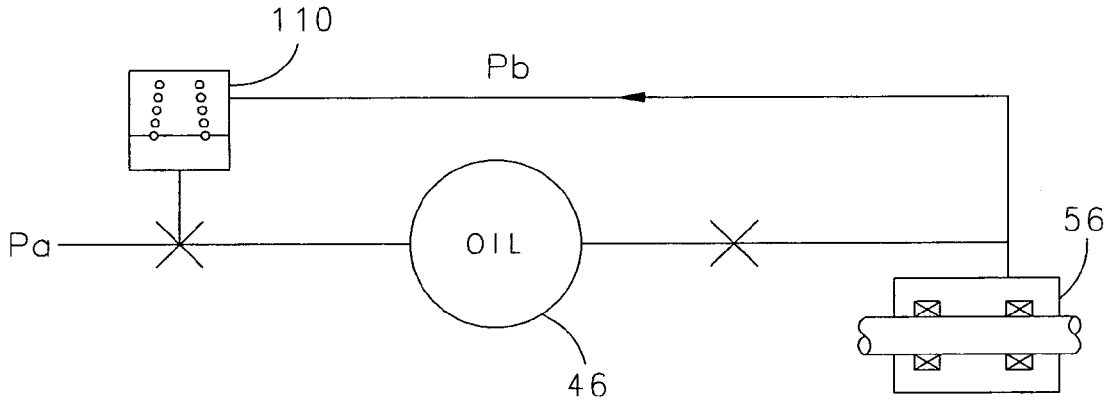
FIG. 5 is a partial schematic illustrating an alternative for the embodiment illustrated in FIG. 4.

As will be apparent, the embodiment illustrated in FIG. 4 provides gas under pressure based solely on the regulated pressure of gas from either the bottle 90 or the engine 20. In some instances, finer control of pressurization may be desired. This is due to the fact that the pressure within the bearing cavity 56 will vary dependent upon altitude and forward velocity, the latter affecting ram air pressure at the inlet to the engine 10 and thus the bearing cavity 56 as well. In such a case, it may be desirable to regulate the pressure applied to the oil source 46 as a function of the pressure from the source in the form of the air bottle 90 or the engine 20 less the opposing pressure, namely, the pressure at the bearings 56. This latter pressure is designated "$P_b$" in FIG. 5 and so the control parameter would then be based on ($P_a$–$P_b$). This may be accomplished by interconnecting the bearing cavity 56 and a pressure regulator 110 which in turn interconnects the gas sources 20 or 90 and the oil source 46 as illustrated in FIG. 5.

Figure 6:
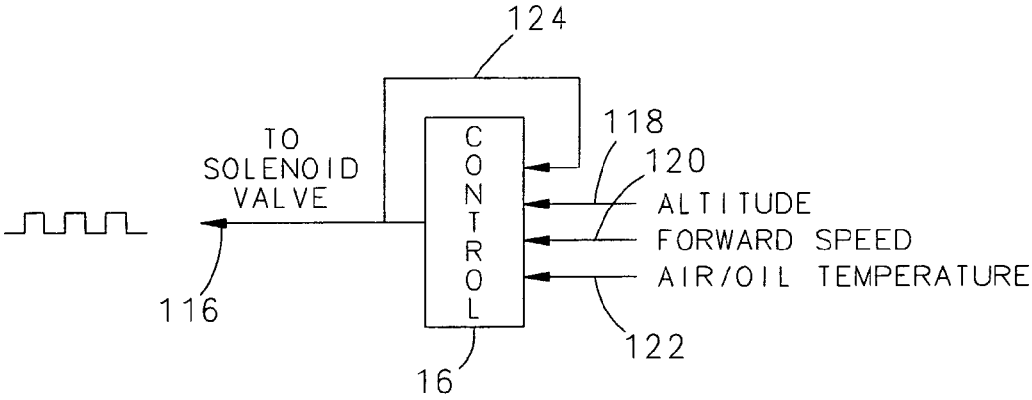
FIG. 6 is a flow diagram illustrating the use of various control parameters.

A simplified control schematic is illustrated in FIG. 6. The control signal to the solenoid valve 70 is indicated by an arrow 116. Arrows 118 and 120 indicate inputs in the form of an indication of altitude and in an indication of forward speed. However, as noted previously, these could be combined into a single input representative of the pressure $P_b$ in the bearing cavity 56. A third input 122 to the control 16 is based on ambient temperature or the temperature of the oil as this is a measure of viscosity. The lower the ambient air or oil temperature, the higher the viscosity, thereby necessitating a longer opening period of the valve 76 by the solenoid 70 to assure adequate flow.

In some instances, a feedback loop 124 may be included. This feedback loop 124 feeds back the pulse rate to compensate for the possible heating effect of the solenoid coil 70 on fuel flowing in the conduit 58. Because of the low oil flow rates typically encountered in apparatus of this sort, rapid pulsing of the solenoid 70 could substantially heat solenoid, which heat would be transferred to the oil to reduce its viscosity and increase its flow rate. The fed back pulse rate provides a measure of possibly heating as a result of rapid pulsing.

From the foregoing, it will be appreciated that a lubrication system for bearings made according to the invention is simple, and consequently, highly reliable in terms of having a minimum number of components subject to failure. Moreover, through the expedient of intermittent flow of the lubricant, pumps need not be employed and yet the flow rate can be reliably controlled within a range where flow is sufficiently low that a large oil source 46 is not required. At the same time, so long as oil flow occurs at least every three seconds, adequate flow of lubricating oil to the bearings 28 is provided.

The use of tank and bladder oil source constructions minimizes the size of the source because they can be completely emptied and provides a means for a long term storage of lubricating oil.

The invention claimed is:

1. A compressed gas powered lubrication system for an expendable gas turbine engine comprising:

a rotatable shaft within said turbine engine;

bearings journaling said shaft for rotation about an axis;

a tank;

a bladder within said tank;

a source of gas under pressure;

one of said tank and said bladder containing lubricating oil for said bearings;

the other of said tank and said bladder being connectable to said source of gas under pressure;

a conduit extending from said one of said tank and said bladder containing lubricating oil to said bearings;

a solenoid operated valve in said conduit and operable only to either fully open or fully close; and a control circuit for pulsing said solenoid at a controlled rate to alternatingly (a) allow oil flow and (b) halt oil flow to said bearings for a time insufficient to cause oil starvation of said bearings.

2. The lubrication system of claim 1 wherein said one of said tank and said bladder is said tank.

3. The lubrication system of claim 1 wherein said one of said tank and said bladder is said bladder.

4. The lubrication system of claim 1 wherein said time is no more than about three seconds.

5. The lubrication system of claim 1 further including a metering orifice in said conduit between said bearings and said solenoid valve.

6. The lubrication system of claim 1 further including a pressure regulator operatively interposed between said other of said tank and said bladder on the one hand and said source of gas under pressure on the other hand.

7. The lubrication system of claim 6 wherein said pressure regulator receives an input representative of pressure at said bearings.

8. The lubrication system of claim 1 wherein said engine is mounted in a vehicle and said control circuit receives inputs representative of vehicle velocity and temperature of the lubricating oil.

9. The lubrication system of claim 1 wherein said vehicle is an airborne vehicle and said control circuit receives an input representative of the altitude of the vehicle.

10. The lubrication system of claim 1 wherein said tank is in sufficiently close proximity to said engine so as to receive heat rejected thereby so that lubricating oil is warmed by engine operation to reduce its viscosity.

11. A compressed gas powered lubrication system for an expendable gas turbine engine in an airborne vehicle engine comprising:

a rotatable shaft within said turbine engine;

bearings journaling said shaft for rotation about an axis;

a tank;

a bladder within said tank;

a source of gas under pressure;

one of said tank and said bladder containing lubricating oil for said bearings;

the other of said tank and said bladder being connectable to said source of gas under pressure;

a pressure regulator interconnecting said source of gas under pressure and said other of said tank and said bladder;

a conduit extending from said one of said tank and said bladder containing lubricating oil to said bearings;

a solenoid operated valve in said conduit and operable only to either fully open or fully close;

a metering orifice in said conduit between said solenoid operated valve and said bearings;

a control circuit for pulsing said solenoid at a controlled rate to alternatingly (a) allow oil flow and (b) halt oil flow to said bearing for a time insufficient to prevent oil starvation of said bearings; and said control circuit receiving inputs representing vehicle velocity, vehicle altitude and lubricating oil or ambient temperature.

12. The lubricating system of claim 11 wherein said pressure regulator is connected to receive a control input representing pressure at said bearings.

13. A compressed gas powered lubricating system for an expendable gas turbine engine comprising:

a rotatable shaft within said turbine engine;

bearings journaling said shaft for rotation about an axis;

a vessel containing lubricating oil;

a conduit extending from said vessel to said bearings;

a solenoid operated valve in said conduit and operable only to either fully open or fully close; and a control circuit for pulsing said solenoid at a controlled rate to alternatingly (a) allow oil flow and (b) halt oil flow to said bearings for a time insufficient to cause oil starvation of said bearings.

* * * * *